US006779213B2

(12) United States Patent
Yip

(10) Patent No.: US 6,779,213 B2
(45) Date of Patent: Aug. 24, 2004

(54) CORK REMOVER

(76) Inventor: Chung Lun Yip, 3rd Floor, Blocks A & C, King Yip Factory Building, No. 59 King Yip Street, Kwun Tong, Kowloon (HK)

( * ) Notice: Subject to any disclaimer, the term of this patent is extended or adjusted under 35 U.S.C. 154(b) by 0 days.

(21) Appl. No.: 10/341,321

(22) Filed: Jan. 13, 2003

(65) Prior Publication Data

US 2004/0112177 A1 Jun. 17, 2004

(30) Foreign Application Priority Data

Feb. 1, 2002 (CN) ..... 02225577 U

(51) Int. Cl.[7] ..... B67B 7/04
(52) U.S. Cl. ..... 7/155; 81/3.45; 81/3.29
(58) Field of Search ..... 7/154–156; 81/3.45, 81/3.29, 3.36, 3.35, 3.09, 3.08

(56) References Cited

U.S. PATENT DOCUMENTS 118,456 A * 8/1871 Jenney ..... 7/155
5,010,790 A * 4/1991 Yen ..... 81/3.45
5,086,675 A * 2/1992 Leung et al. ..... 81/3.29
5,351,579 A * 10/1994 Metz et al. ..... 81/3.45
2003/0037380 A1 * 2/2003 Bartholomew ..... 7/155

* cited by examiner

*Primary Examiner*—Debra Meilsin
(74) *Attorney, Agent, or Firm*—Ladas & Parry

(57) ABSTRACT

A cork remover comprising a handle having first engaging means and an elongate cavity including internal screw threads along its length, and a separate corkscrew having a head fixed to its rear end and receivable by the cavity. The head has second engaging means for releasable engagement with the first engaging means against rotation of the corkscrew relative to the handle, such that the corkscrew can be turned into a cork of a wine bottle by rotating the handle. The head includes external screw threads for subsequent engagement with the screw threads of the cavity while being received by the cavity in one direction, such that upon rotation of the handle the corkscrew can be withdrawn rearwards into the cavity, thereby removing said cork from said bottle. The head is receivable by the cavity in the opposite direction, having their screw threads inter-engaged, for storing the corkscrew in the cavity.

9 Claims, 5 Drawing Sheets

CORK REMOVER

BACKGROUND OF THE INVENTION

Cork removers incorporating a corkscrew are available in many designs. Some corkscrews are separate and cannot be secured with the rest of cork removers, which makes storage inconvenient and also unsafe should the corkscrews be exposed that often have a sharp end.

The invention seeks mitigate or at least alleviate such a problem by providing an improved cork remover.

SUMMARY OF THE INVENTION

According to the invention, there is provided a cork remover comprising a handle having first engaging means and an elongate cavity including internal screw threads along its length, and a separate corkscrew having a head fixed to its rear end and receivable by the cavity. The head has second engaging means for releasable engagement with the first engaging means against rotation of the corkscrew relative to the handle, such that the corkscrew can be turned into a cork of a wine bottle by rotating the handle. The head includes external screw threads for subsequent engagement with the screw threads of the cavity while being received by the cavity in one direction, such that upon rotation of the handle the corkscrew can be withdrawn rearwards into the cavity, thereby removing said cork from said bottle. The head is receivable by the cavity in the opposite direction, having their screw threads inter-engaged, for storing the corkscrew in the cavity.

Preferably, the handle is elongate and has opposite first and second open ends, with its first engaging means positioned at the first end and its cavity extending from the first engaging means along the length of the handle to the second end.

More preferably, the handle is substantially tubular.

In a preferred embodiment, the first and second engaging means comprise inter-engageable splines.

More preferably, the handle is substantially tubular and has an open end whose inner peripheral surface includes the splines.

It is preferred that the head has a cylindrical upper portion whose outer surface includes the second engaging means, and a radially enlarged cylindrical lower portion whose outer surface includes the external screw threads, and the corkscrew projects downwardly from the lower portion.

In a preferred embodiment, the cork remover includes a cutting disc supported by the handle for free rotation, the disc having an exposed cutting edge for cutting a sealing foil of said bottle.

More preferably, the handle is substantially cylindrical and includes an end having a reduced cross-section to form a shoulder on which the cutting disc is supported for rotation about an axis substantially perpendicular to the handle.

Further more preferably, the handle end includes a guide member adjacent the cutting disc for bearing against said cork to position the cutting disc for cutting said foil.

BRIEF DESCRIPTION OF DRAWINGS

The invention will now be more particularly described, by way of example only, with reference to the accompanying drawing, in which.

DETAILED DESCRIPTION OF PREFERRED EMBODIMENT

Figure 1:
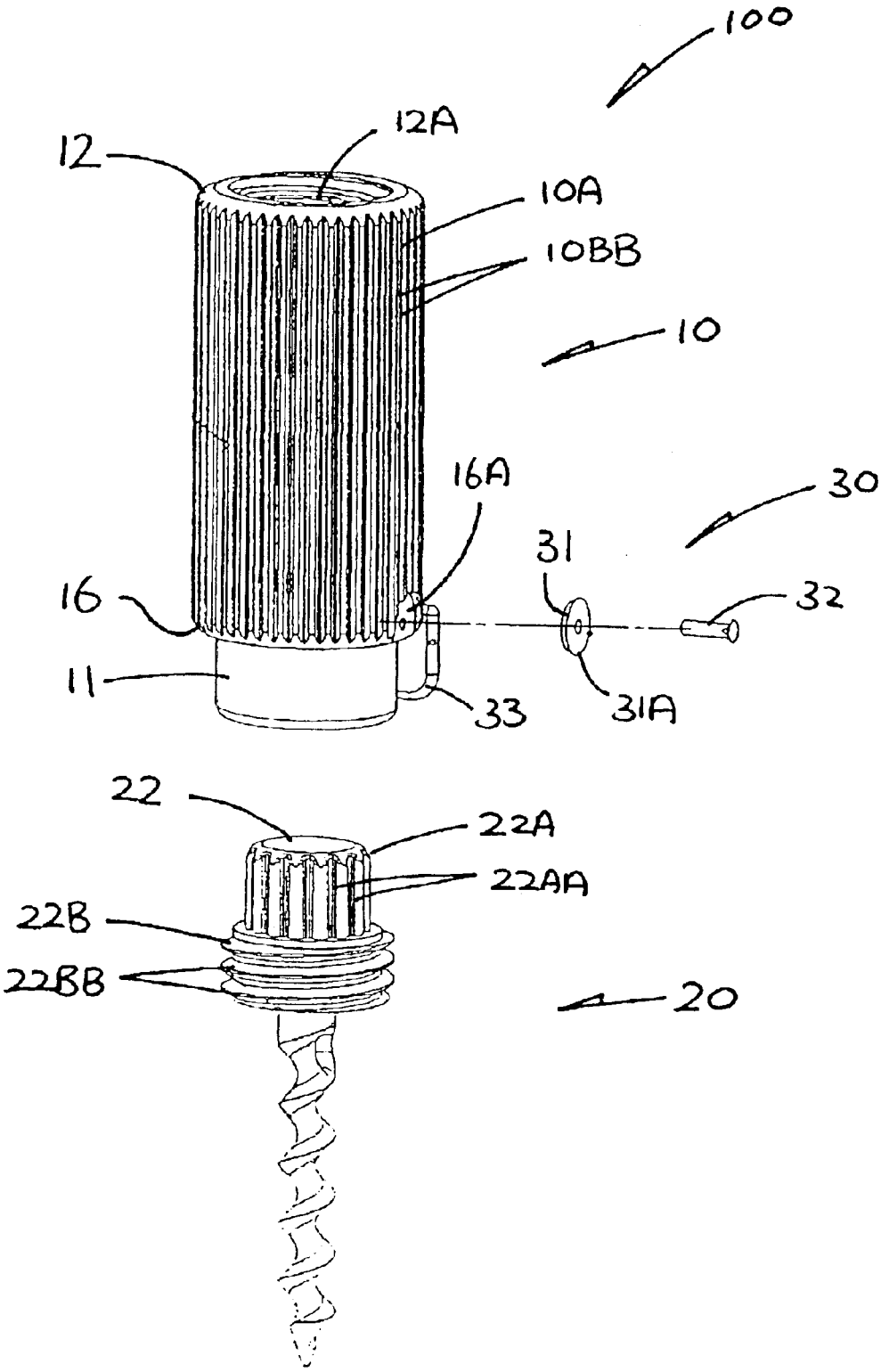
FIG. 1 is a perspective view of an embodiment of a cork remover in accordance with the invention, said remover having a handle, a corkscrew and a cutter (disassembled)

Referring to the drawings, there is shown a cork remover 100 embodying the invention, which remover 100 comprises a tubular handle 10 and a helical corkscrew 20 for piercing into the cork 41 of a wine bottle 40. The corkscrew 20 is a separate item from the handle 10. A rotary cutter 30 is included for cutting a tin foil 42 sealing the cork 41.

The handle 10 has a cylindrical outer surface 10A that is knurled or otherwise formed with alternating ribs and grooves 10AA to facilitate gripping, and includes a cylindrical inner surface 10B formed with screw threads 10BB along its length. A first open end 11 of the handle 10 is slightly reduced in diameter, on the inner surface of which splines 11A are formed. An opposite, second open end 12 of the handle 10 has the same cross-section as the main handle body, to which the screw threads 10BB extend as screw threads 12A.

The handle 10 includes a partition 13 that extends transversely within the handle 10 at a position much closer to the first handle end 11 than the second handle end 12. The partition 13, having a central hole 13A, divides the interior of the handle 10 into short and long cavities 14 and 15 that are open at the handle ends 11 and 12 respectively. The inner peripheral surfaces of the cavities 14 and 15 are fully occupied by the splines 11A and screw threads 10BB respectively.

The corkscrew 20 includes a circular head 22 fixed co-axially to the upper or rear end thereof. The head 22 has a cylindrical upper portion 22A whose outer surface is formed with splines 22AA, and includes a cylindrical lower portion 22B co-axial with the upper portion 22A, which is radially enlarged and whose outer surface is formed with screw threads 22BB.

Figure 3:
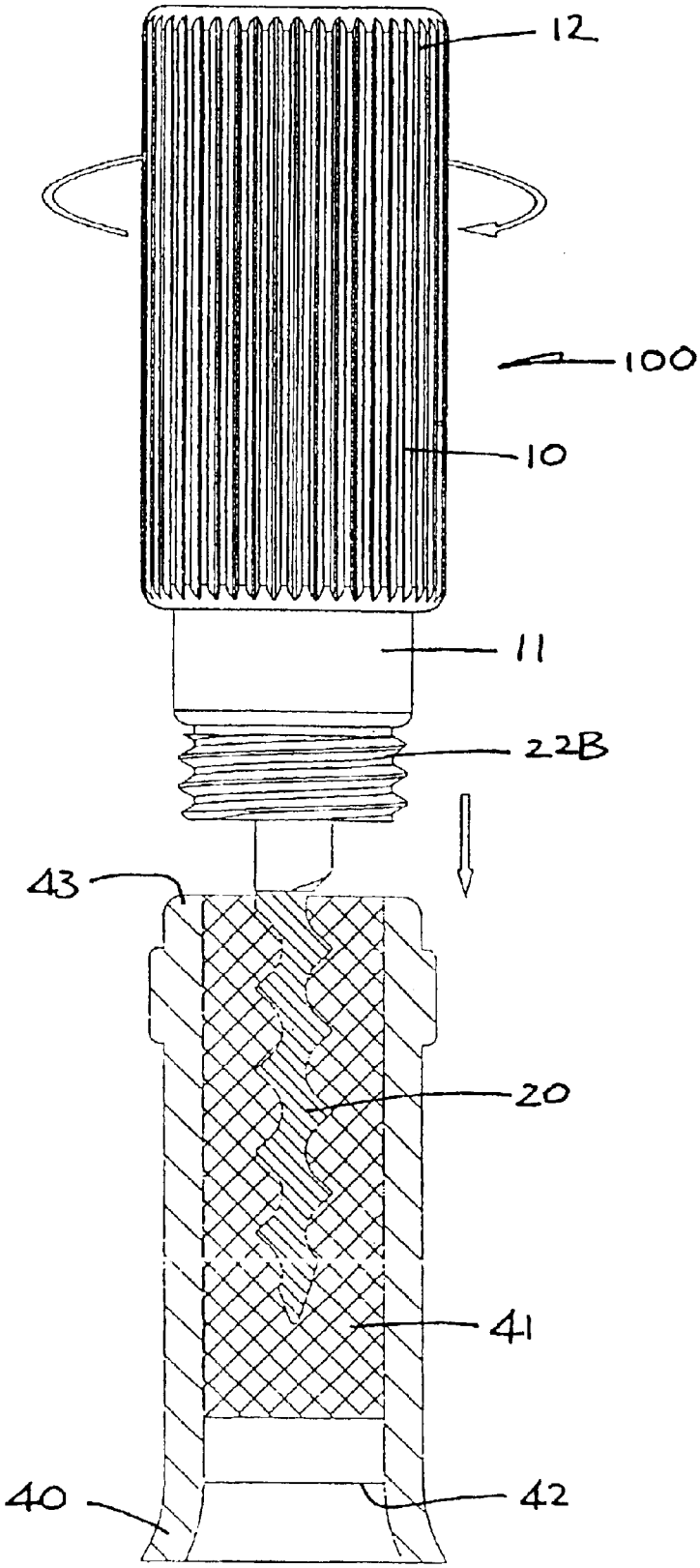
FIG. 3 is a partially cross-sectioned side view illustrating how the corkscrew of FIG. 1 is driven into a cork of the bottle.

The upper head portion 22A has a slightly smaller diameter than the opening of the first handle end 11 or cavity 14, for engagement therein by their splines 22AA and 11A. This results in a first operating configuration of the cork remover 100 (FIG. 3), in which the corkscrew 20 extends co-axially from the handle 10 and is fixed thereto against relative rotation. In this configuration, the corkscrew 20 may be driven into the bottle cork 41 by a user gripping and rotating the handle 10 clockwise.

The lower head portion 22B has a slightly smaller diameter than the opening of the second handle end 12 or cavity 15, for engagement therein by their screw threads 22BB and 10BB. This results in a second operating configuration of the cork remover 100 (FIG. 4), in which the corkscrew 20 extends co-axially relative to the handle 10 in the opposite direction compared with the first configuration. Also, the corkscrew 20 is now rotatable relative to the handle 10 as a result of screwing action between the screw threads 22BB and 10BB.

After the corkscrew 20 has been driven fully into the bottle cork 41 (FIG. 3), the handle 10 is detached from the screw head 22. The handle 10 is then turned upside down and re-connected to the head 22, this time using the opposite handle end 12, by being screwed clockwise onto the lower head portion 22B. The handle end 12 will travel downwards while enclosing the head 22 and will soon abut a lip 43 of the bottle 40.

Figure 4:
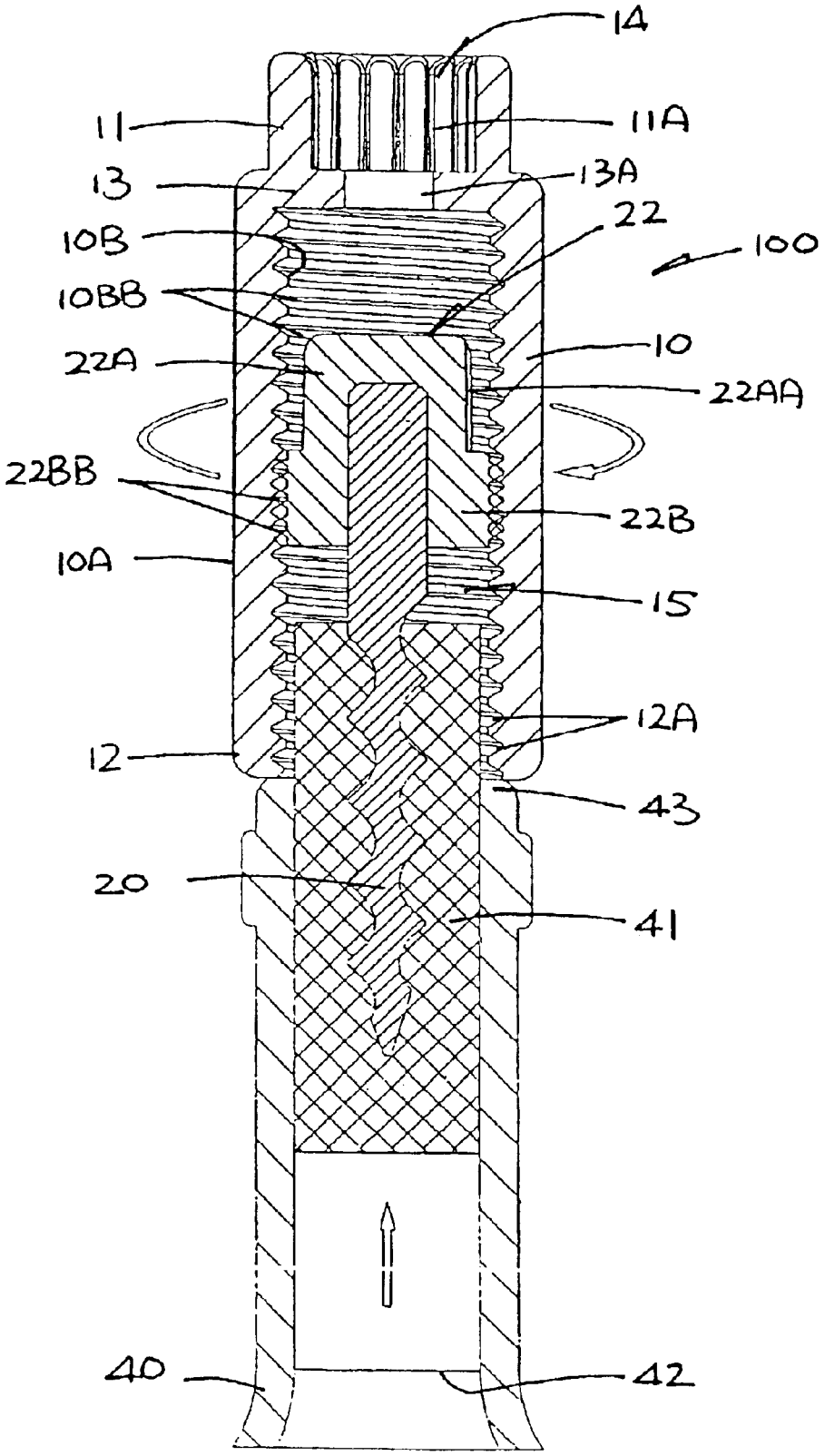
FIG. 4 is a cross-sectional side view illustrating how the corkscrew of FIG. 3 is subsequently withdrawn to remove the cork from the bottle.

Upon continual rotation, as the handle 10 can no longer travel downwards, the screw head 22 instead will be turned anti-clockwise through screwing action between the screw threads 22BB and 10BB and thus moved upwards further into the handle 10. In doing so, the head 22 travels upwardly through and along the length of the cavity 15, thereby turning and lifting the corkscrew 20 and as a result withdrawing the cork 41 from the bottle 40 (FIG. 4).

The cavity 15 may be sufficiently long to accommodate the whole piece of cork 41 when it becomes free before the screw head 22 is stopped by the partition 13, otherwise the cork 41 may simply be pulled out manually afterwards given that it has already been withdrawn considerably outwards. After the cork 41 has been removed from the bottle 40, it can be unscrewed anti-clockwise from the corkscrew 20.

Figure 5:
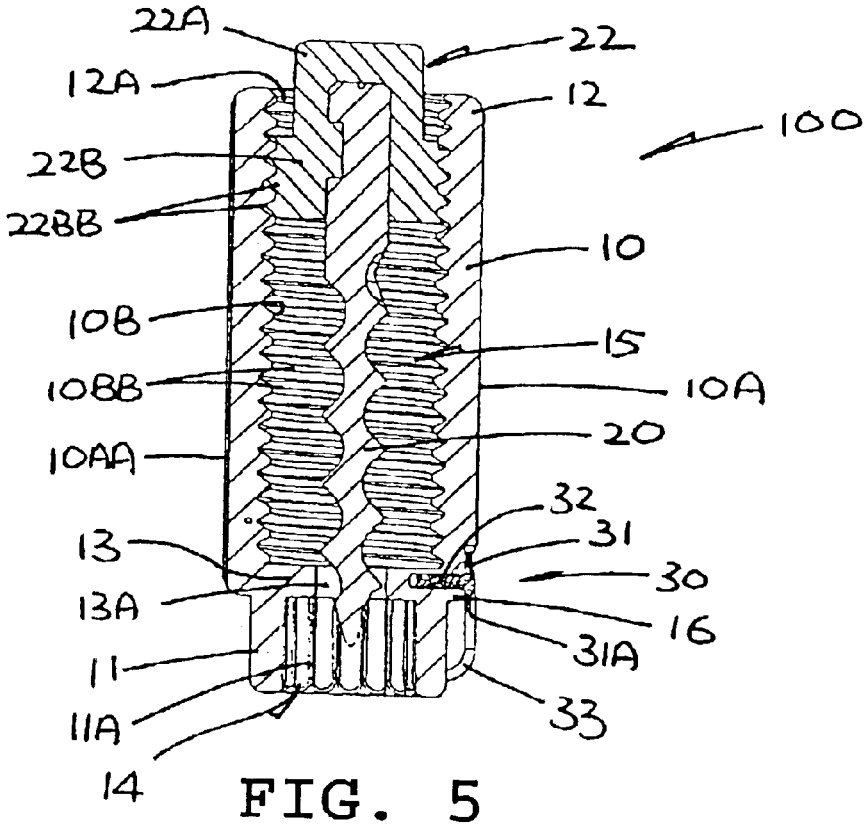
FIG. 5 is a cross-sectional side view of the cork remover of FIG. 1, in a storage configuration.
Figure 6:
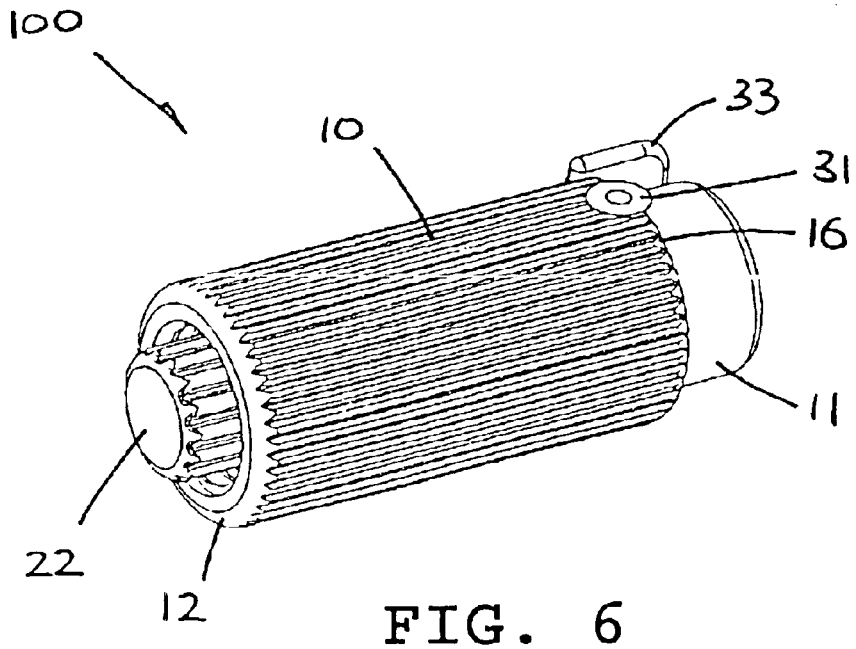
FIG. 6 is a perspective view of the cork remover of FIG. 5.

The corkscrew 20 may be stored inside the handle 10 (FIG. 5), by inserting it into the longer cavity 15 through the associated handle end 12 and then turning the trailing screw head 22 clockwise into the handle end 12 through screwing action between the screw threads 22BB and 12A. In doing so, the head 22 is received by the cavity 15 for storing the corkscrew 20 in the opposite direction compared with the second operating configuration for withdrawing the cork 41. The handle 10 is sufficiently long to accommodate the entire corkscrew 20, with the latter extending through the aperture 13A of the partition 13.

Figure 2:
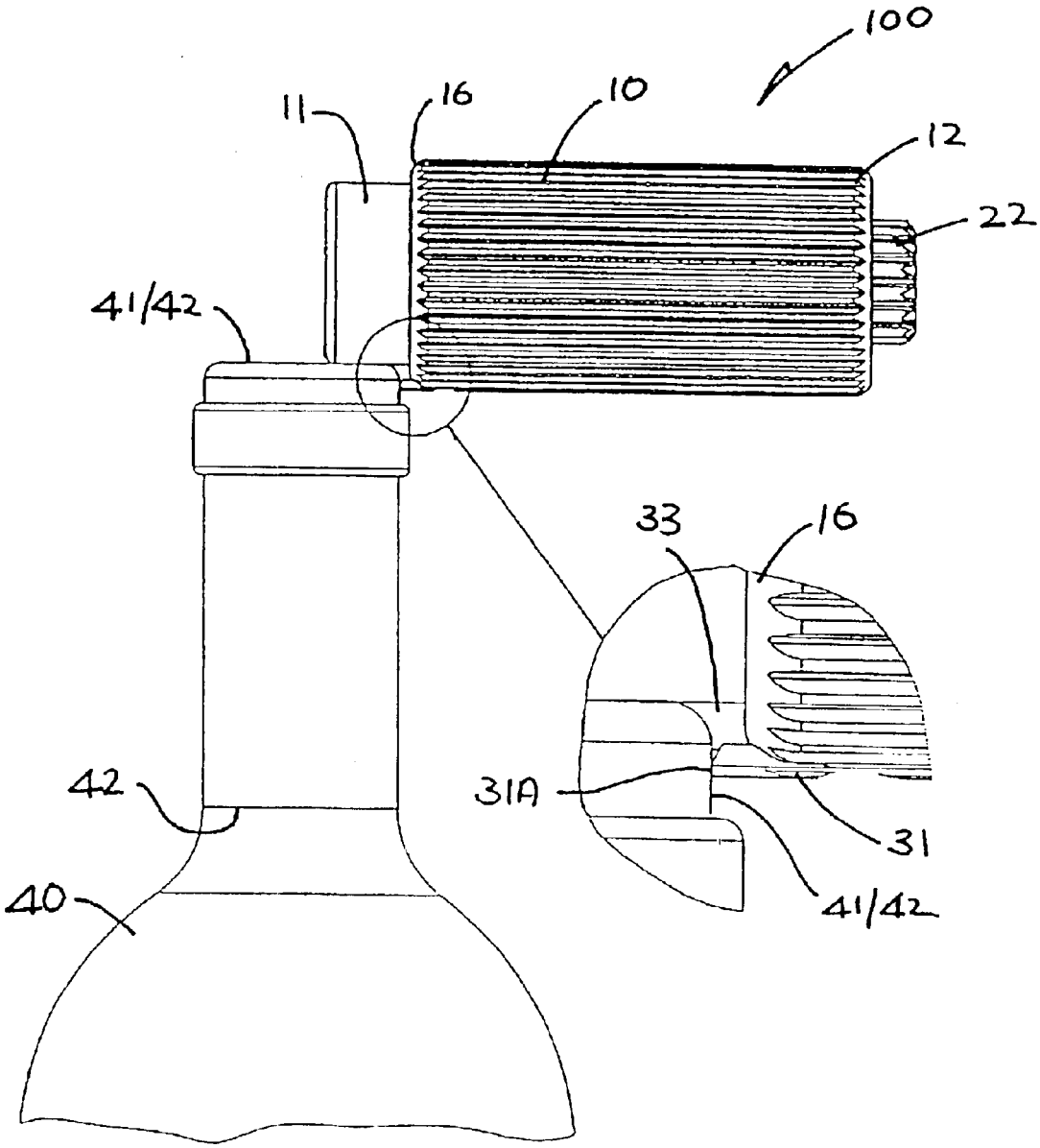
FIG. 2 is a side view illustrating how the cutter of FIG. 1 is used to cut a sealing foil of a wine bottle.

The foil cutter 30 comprises a cutting disc 31 and an axle pin 32 therefor. The first handle end 11 has a reduced diameter or cross-section to form an annular shoulder 16 including a seat 16A on one side, on which the disc 31 is supported by the pin 32 for free rotation about an axis perpendicular to the longitudinal axis of the handle 10. The disc 31 has a cutting edge 31A exposed by protruding beyond the shoulder 16 for cutting the sealing foil 42 of the bottle 40 (FIG. 2) prior to the removal of the cork 41 as described above.

The first handle end 11 includes an integral guide member in the form of an inclined plate 33 that extends axially along the handle end 11 and adjacent one side of the cutting disc 31. The plate 33 serves as an abutment for bearing against the outermost end of the cork 41 to position the disc 31 for cutting the foil 42.

It is envisaged that the inter-engaging means for fixing the corkscrew 20 to the handle 10 in the first operating configuration may take any form other than the splines 11A and 22AA, so long as they do not permit rotation of the corkscrew 20 relative to the handle 10. The alternatives include any non-circular mating cross-sections.

Also, the corkscrew 20 may be connected to any other part of the handle 10 and at any other direction relative thereto, for example to its mid-length at right angles thereby forming a T-shaped structure to facilitate piercing of the corkscrew 20 into the cork 41.

It is clear that the outer surface 10A of the handle 10 needs not have a circular cross-section.

The invention has been given by way of example only, and various other modifications of and/or alterations to the described embodiment may be made by persons skilled in the art without departing from the scope of the invention as specified in the appended claims.

What is claimed is:

1. A cork remover comprising:

a handle having first engaging means and an elongate cavity including internal screw threads along its length; and a separate corkscrew having a head fixed to its rear end and receivable by the cavity;

the head having second engaging means for releasable engagement with the first engaging means against rotation of the corkscrew relative to the handle, such that the corkscrew can be turned into a cork of a wine bottle by rotating the handle;

the head including external screw threads for subsequent engagement with the screw threads of the cavity while being received by the cavity in one direction, such that upon rotation of the handle the corkscrew can be withdrawn rearwards into the cavity, thereby removing said cork from said bottle;

the head being receivable by the cavity in the opposite direction, having their screw threads inter-engaged, for storing the corkscrew in the cavity.

2. The cork remover as claimed in claim 1, wherein the handle is elongate and has opposite first and second open ends, with its first engaging means positioned at the first end and its cavity extending from the first engaging means along the length of the handle to the second end.

3. The cork remover as claimed in claim 2, wherein the handle is substantially tubular.

4. The cork remover as claimed in claim 1, wherein the first and second engaging means comprise inter-engageable splines.

5. The cork remover as claimed in claim 4, wherein the handle is substantially tubular and has an open end whose inner peripheral surface includes the splines.

6. The cork remover as claimed in claim 1, wherein the head has a cylindrical upper portion whose outer surface includes the second engaging means, and a radially enlarged cylindrical lower portion whose outer surface includes the external screw threads, and the corkscrew projects downwardly from the lower portion.

7. The cork remover as claimed in claim 1, including a cutting disc supported by the handle for free rotation, the disc having an exposed cutting edge for cutting a sealing foil of said bottle.

8. The cork remover as claimed in claim 7, wherein the handle is substantially cylindrical and includes an end having a reduced cross-section to form a shoulder on which the cutting disc is supported for rotation about an axis substantially perpendicular to the handle.

9. The cork remover as claimed in claim 8, wherein the handle end includes a guide member adjacent the cutting disc for bearing against said cork to position the cutting disc for cutting said foil.

* * * * *